US006473049B2

(12) United States Patent
Takeuchi et al.

(10) Patent No.: US 6,473,049 B2
(45) Date of Patent: Oct. 29, 2002

(54) ANTENNA DEVICE

(75) Inventors: Shoichi Takeuchi, Kanagawa (JP); Fuminori Watanabe, Kanagawa (JP); Koji Ikawa, Kanagawa (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 09/997,004

(22) Filed: Nov. 30, 2001

(65) Prior Publication Data

US 2002/0101390 A1 Aug. 1, 2002

(30) Foreign Application Priority Data

Dec. 7, 2000 (JP) ..... 2000-372819

(51) Int. Cl.[7] ..... H01Q 19/06

(52) U.S. Cl. ..... 343/753; 343/781 CA; 343/911 R

(58) Field of Search ..... 343/753, 755, 343/781 R, 781 P, 781 CA, 910, 911 R, 911 L

(56) References Cited

U.S. PATENT DOCUMENTS 5,360,973 A * 11/1994 Webb ..... 250/370.01

FOREIGN PATENT DOCUMENTS

| | | |
|---|---|---|
| DE | 197 37 254 | 3/1999 |
| GB | 2 236 019 | 3/1991 |
| JP | 3-178204 | 8/1991 |
| JP | 3-183202 | 8/1991 |
| JP | 4-134909 | 5/1992 |
| JP | 5-191136 | 7/1993 |
| JP | 11-27035 | 1/1999 |
| JP | 11-150416 | 6/1999 |
| WO | WO 88/10521 | 12/1988 |
| WO | WO 90/07199 | 6/1990 |

OTHER PUBLICATIONS

Patent Abstracts of Japan, JP 04–134909, May 8, 1992.

L. C. J. Baggen, et al., International Journal of Infrared and Millimeter Waves, vol. 14, No. 6, XP–000381014, pp. 1341–1352, "Design Procedure for a Fresnel–Zone Plate Antenna" Jun. 1, 1993.

* cited by examiner

*Primary Examiner*—Don Wong
*Assistant Examiner*—Shih-Chao Chen
(74) *Attorney, Agent, or Firm*—Oblon, Spivak, McClelland, Maier & Neustadt, P.C.

(57) ABSTRACT

An antenna device of simple structure and high performance which is capable of lessening a reduction of a converging efficiency of radio wave due to a window glass sheet or the like to which the antenna device is fitted, and capable of obtaining a high converging efficiency to a received radio wave. The antenna device comprises a fitted member (5) having transparency, a converging member (1) for converging a radio wave, a space between the fitted member (5) and the converging member (1), and a receiving portion for receiving the radio wave converged by the converging member (1) or a transmitting portion for radiating a radio wave to the converging member (1) wherein in a case that a receive power value is changed so as to take alternately a bottom value and a peak value depending on a change of the thickness of the space, the thickness of the space is adjusted so that the received power value does not take a value in the vicinity of bottom values.

18 Claims, 8 Drawing Sheets

ANTENNA DEVICE

The present invention relates to an antenna device. In particular, the present invention relates to an antenna device in a microwave range and a millimeter wave range used for wireless communication and broadcast.

Heretofore, as an antenna for wireless communication or broadcast, there has been known a so-called parabola antenna for converging a radio wave to the focal point by means of a reflector such as one having a parabolic face. In order to set the parabola antenna, a column support having the thickness sufficient to obtain a sufficient strength, in consideration of the own weight of the antenna, wind, snow and so on, at the outside, e.g., the rooftop of an architectural structure such as a building, and a reflector is fixed to the column support, for example. Such antenna device is required to have durability so as to prevent the antenna or the support becoming rusty because the antenna device is exposed to rain water. However, the antenna device decays relatively fast and maintenance is necessary. Further, since the parabola antenna is set up at the outside, there is a problem of damaging the entire outer appearance of the architectural structure such as a building.

Accordingly, there have been considered that a parabola antenna or the like is set up in a room, or a lens or a diffraction grating is disposed at an opening of the building to converge the radio wave and increase energy density so that the radio wave is received. JP-A-11-150416 (concerning an antenna, Deutsche Telecom A.G.) proposes an antenna comprising a structure for diffracting electromagnetic signals in microwave and millimeter wave ranges, which is used instead of a window, or is integrally attached to a window or a part thereof. This publication proposes to attach a visually transparent diffraction structure (e.g., a Fresnel zone plate) or to unify it with a window.

JP-A-4-134909 discloses a diffracting ring type antenna comprising a diffraction ring having a transparent conductive thin film of high transparency formed on a window glass and a pickup antenna for receiving signals, which is disposed at or in the vicinity of the focal position of the diffraction ring. Further, the publication describes a technique that the diffraction ring made of the transparent conductive thin film is disposed on a transparent insulating plate and a one-piece body of the diffraction ring and the transparent insulating plate is attached to a window glass with an adhesive layer formed by coating an adhesive on a surface of the one-piece body.

However, when the antenna having the diffraction ring for converging the radio wave was attached to the window, there was a problem that a sufficient signal receiving performance could not be obtained due to loss caused by multipath reflection and so on caused between the diffraction ring and the window glass sheet. In particular, there was a problem that the multipath reflection and so on caused between the diffraction ring and the window glass sheet affected largely because of a short wavelength in the millimeter wave range or the microwave range.

It is an object of the present invention to eliminate the above-mentioned problems and to provide the invention described below.

(A) An antenna device which comprises a fitted member having transparency, a converging member for converging a radio wave, a space between the fitted member and the converging member, and a receiving portion for receiving the radio wave converged by the converging member and/or a transmitting portion for radiating a radio wave to the converging member.

(B) The antenna device described in the above-mentioned (A), wherein the fitted member is a window glass sheet fitted to a building; the converging member has a flat face, and the space is a space constituted by inclining relatively the converging member with respect to the window glass sheet.

(C) The antenna device described in the above-mentioned (A) or (B), wherein in a case that a receive power value is changed so as to take alternately a bottom value and a peak value depending on a change of the thickness of the space in the relation between the thickness of the space and the received power value, the thickness of the space is adjusted so that the received power value does not take a value in the vicinity of bottom values.

(D) The antenna device described in the above-mentioned (C), wherein in a case that the thickness of the fitted member satisfies the following formula (1) with respect to the wavelength of the radio wave and the incident angle of the radio wave, the space has an adjusted thickness:

$$\left(\frac{2n+1}{4}-\frac{1}{5}\right)\cdot\lambda_d \le L \le \left(\frac{2n+1}{4}+\frac{1}{5}\right)\cdot\lambda_d \tag{1}$$

where n is an integer of 0 or more;

$\lambda_d$ is a wavelength of the radio wave passing through the fitted member;

$$\lambda_d = \frac{\lambda}{\sqrt{\varepsilon_r - \sin^2\theta}}$$

($\lambda$ is a wavelength of the radio wave in vacuum, $\epsilon_d$ is the relative permittivity of the fitted member, and $\theta$ is an incident angle of the radio wave), and L is a thickness of the fitted member.

(E) An antenna device which comprises a flat fitted member having transparency, an antenna member for transmitting a radio wave and/or receiving a radio wave and a space between the fitted member and the antenna member wherein in a case that a received power value is changed so as to take alternately a bottom value and a peak value depending on a change of the thickness of the space in the relation between the thickness of the space and the received power value in the antenna member, the thickness of the space is adjusted and determined so that the received power value does not take a value in the vicinity of bottom values.

Here, the antenna member includes the converging member for converging a radio wave and the transmitting portion and/or the receiving portion which transmits and/or receives a radio wave in the same manner as the antenna device described in the above-mentioned (A).

(F) The antenna device described in the above-mentioned (E), wherein in a case that the thickness of the fitted member satisfies the following formula (2) with respect to the wavelength of the radio wave and the incident angle of the radio wave, the space has an adjusted thickness:

$$\left(\frac{2n+1}{4}-\frac{1}{5}\right)\cdot\lambda_d \le L \le \left(\frac{2n+1}{4}+\frac{1}{5}\right)\cdot\lambda_d \tag{2}$$

where n is an integer of 0 or more;

$\lambda_d$ is a wavelength of the radio wave passing through the fitted member;

$$\lambda_d = \frac{\lambda}{\sqrt{\varepsilon_r - \sin^2\theta}}$$

($\lambda$ is a wavelength of the radio wave in vacuum, $\epsilon_r$ is the relative permittivity of the fitted member, and $\theta$ is an incident angle of the radio wave), and L is a thickness of the fitted member.

(G) A method for arranging in substantially parallel a converging member for converging a radio wave closely to a fitted member wherein in a case that a received power value is changed so as to take alternately a bottom value and a peak value in the relation between the received power value and the thickness of a space between the converging member and the fitted member such as a window glass sheet, the thickness of the space is adjusted so that the received power value does not take a value in the vicinity of bottom values.

(H) A method for arranging in substantially parallel an antenna member closely to a fitted member such as a window glass sheet or the like in the construction of an antenna device wherein in a case that a received power value is changed so as to take alternately a bottom value and a peak value in the relation between the thickness of a space between the antenna member and the fitted member and the received power value, the thickness of the space is adjusted and determined so that the received power value does not take a value in the vicinity of bottom values. In particular, the method for arranging an antenna member wherein in a case that the thickness of the fitted member satisfies the above-mentioned formula (2), the thickness of the space is adjusted under determination.

(I) The antenna device or the method for arranging the same described in any one of the above-mentioned (A) to (H) wherein the radio wave is a radio wave in a microwave range or a millimeter wave range. Here, the microwave means a radio wave having a frequency of about 1 GHz–3 THz, and the millimeter wave means a radio wave having a frequency of about 30 GHz–300 GHz. The millimeter wave constitutes a part of the microwave band.

(J) The antenna device or the method for arranging the same described in any one of the above-mentioned (A) to (I) wherein the converging member is to converge, diffract, amplify or deflect the radio wave.

(K) The antenna device or the method for arranging the same described in any one of the above-mentioned (A) to (J) wherein the converging member is a Fresnel zone plate.

(L) With respect to the antenna device described in any one of the above-mentioned (A) to (K) in this specification, the function of receiving a radio wave is mainly described. However, the antenna device according to the present invention may be an antenna device for transmitting the radio wave in a predetermined direction by utilizing reversibility of transmitting/receiving the radio wave so that the radio wave radiated from a transmitting portion is diffracted or deflected to form a plane wave. Further, the above-mentioned formula (1) is the same as the above-mentioned formula (2). Accordingly, the formula (1) is used as a representative example.

Figure 1:
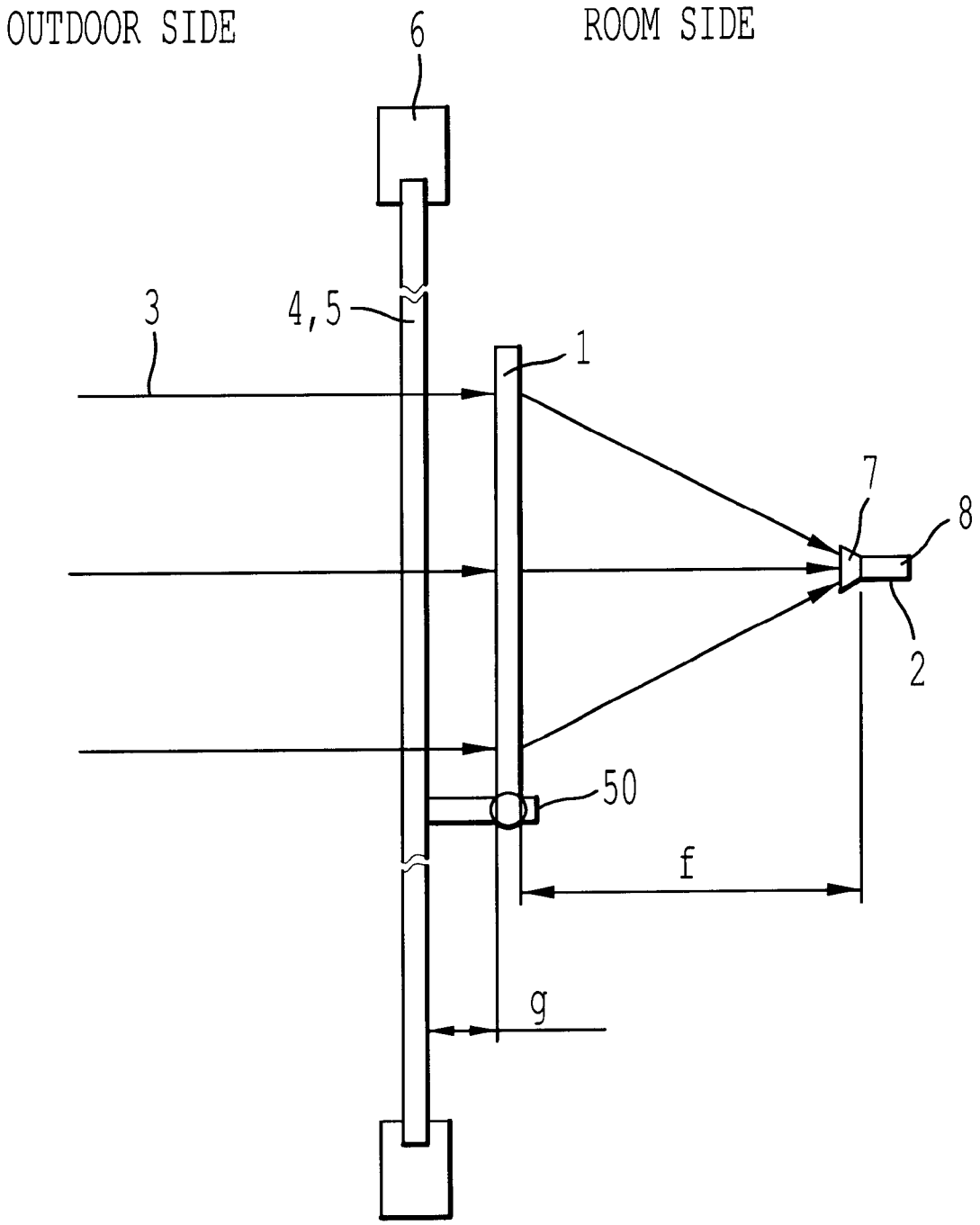
FIG. 1 is a diagram showing a side face of an embodiment of the antenna device of the present invention.

In the following, preferred embodiments of the present invention will be described in detail. However, the present invention is not limited to the concrete examples described in this specification.

Description will be made as to a first embodiment and a second embodiment of the present invention wherein the first embodiment corresponds to the antenna device of the above-mentioned (A) to (D), and the second embodiment corresponds to the antenna device in the above-mentioned (E) and (F).

First, the first embodiment of the present invention will be described.

The antenna device according to the first embodiment of the present invention comprises a fitted member having transparency, a converging member for converging a radio wave, a space between the fitted member and the converging member, and a receiving portion for receiving the radio wave converged by the converging member and/or transmitting portion for radiating a radio wave to the converging member.

The fitted member in the first embodiment is an article or a structure having transparency in visual sense arranged at a predetermined angle and position to a radio wave. Specifically, the fitted member is a glass sheet, a plastic film, a plastic plate or the like fitted to a building or a vehicle such as an automobile or the like.

The shape and the application of the fitted member is not in particular limited. For example, the fitted member may be 1) a transparent glass sheet made of soda lime glass, or a window glass sheet such as a frost glass sheet or the like, 2) a window glass sheet for a vehicle such as an automobile, 3) a plastic film made of PET or the like, 4) a plastic plate made of acrylic resin or the like and 5) a glass sheet window and a plastic window used for a gauge or the like.

The converging member for converging the radio wave in the first embodiment is not in particular limited but it may be a known structure. As an example, a structure for converging a radio wave by a plane diffraction ring, particularly, a structure using a Fresnel zone plate may be mentioned although the present invention is not limited thereto. It is preferable that the converging member is constituted to have a flat face. However it is not always necessary to be flat, and it may have a three-dimensional shape as Fresnel lens. Or it may be a radio wave converging member in which radio wave diffracting elements are formed stepwisely in a direction of the thickness of a transparent member such as a glass plate or the like to correct a phase difference of the radio wave, or a radio wave converging member having a phase-corrected structure in which a dipole or the like is arranged under adjustment in each zone. In order to form the radio wave diffracting elements stepwisely in a direction of the thickness of the glass plate, the glass plate may be subject to a plurality of times of etching, or the glass plate may be cut with use of a grinding stone.

The Fresnel zone plate is simply called as a zone plate or a Fresnel (ring) band plate (see, for example, "Introduction to Optical Engineering" written by Tsutomu Ogawa and Moriaki Wakaki, published by JIKKYO publishing company), and it comprises a substrate and a Fresnel zone portion formed thereon. The Fresnel zone portion has the function as described hereinbelow.

Figure 2:
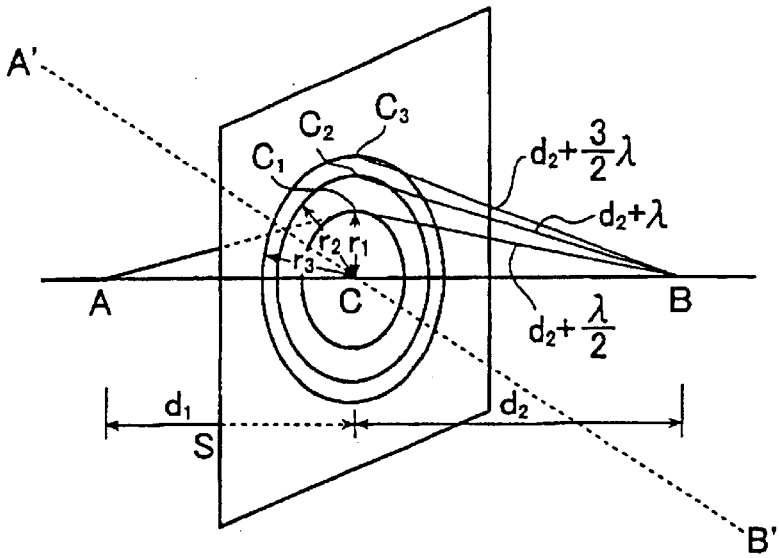
FIG. 2 is a diagram for explaining Fresnel zone.

As shown in FIG. 2, a transmitting point for transmitting a radio wave (light) having a wavelength $\lambda$ is determined to be A and a receiving point of radio wave is to be B, and then, concentric circles each having a radius $r_1$, $r_2$, . . . or $r_m$ are drawn around the center point C on a flat plane S including the center C. Here, the radius r of a concentric circle is determined so that the distances between the points $C_1$, $C_2$, . . . $C_m$ on the concentric circles and the point B are elongated respectively by $\lambda/2$, $\lambda$, . . . , $m\lambda/2$ with respect to the distance between the point C and the point B. Since electric fields passing through annular ranges as zones defined by adjacent concentric circles are different in phase by $\lambda/2$ due to the difference of propagation path formed between adjacent zones, there appear alternately phases of radio wave at the receiving point B. The Fresnel zone portion has the annular portions defined by a plurality of concentric circles in which a transmitting portion and a non-transmitted portion of radio wave are formed alternately, and the radio wave having a wavelength $\lambda$ transmitted from the transmitting point A is diffracted at the point C in the plane S to be converged to a receiving point B.

Figure 3:
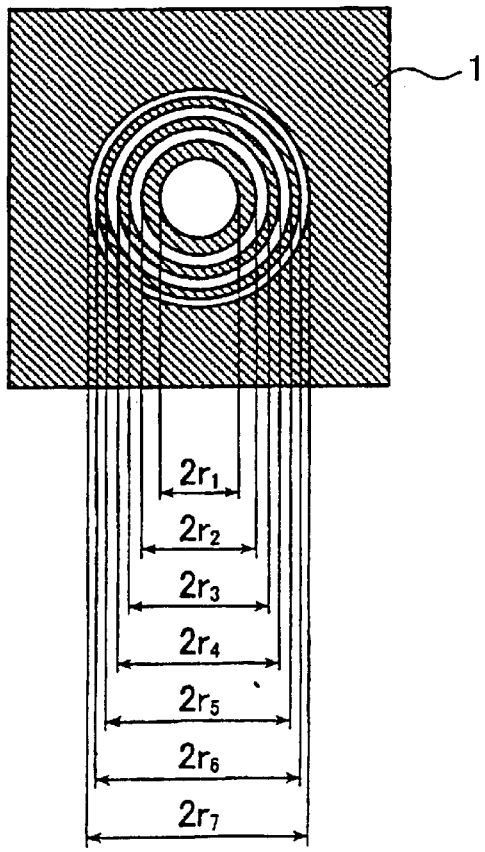
FIG. 3 is a plane view of a converging member in FIG. 1.

Accordingly, a pattern having the annular portions defined by a plurality of adjacent concentric circles, which provide a transmitting portion and a non-transmitting portion of radio wave alternately, is usable as a converging element having a positive focal length and a negative focal length with respect to a radio wave having a wavelength $\lambda$. FIG. 3 shows an example of such pattern of Fresnel zone in which the pattern is formed in a flat surface of a transparent substrate. However, it is not always necessary to form, on a single flat surface, the annular ring group or an annular elliptic ring group which is described hereinbelow, both of which have a plurality of annular ring portions constituting a transmitting portion and a non-transmitting portion of radio wave alternately, but the pattern may be formed in a plurality of different flat surfaces if the radio wave can be converged thereto.

When the distance from the transmitting point A to the point C and the distance from the receiving point B to the point C are respectively $d_1$ and $d_2$ in FIG. 2, the radius $r_m$ of the m th zone is expressed by the following formula (3):

$$r_m = \sqrt{\frac{m\lambda d_1 d_2}{(d_1 + d_2)}} \tag{3}$$

where m=1, 2, 3, . . . m (natural number).

Namely, the pattern of Fresnel zone is constituted by a plurality of circular ring-type patterns each having a radius value in proportion to a square root of the product of a numerical number of concentric circle m counted from the center and the wavelength $\lambda$.

The shape of the pattern of Fresnel zone is designed according to use conditions. The above-mentioned description concerns a case that a radio wave is incident perpendicularly to the flat plane S, and the pattern of Fresnel zone provides a group of concentric circles wherein a radio wave transmitting portion and a radio wave non-transmitting portion each having an annular shape are formed alternately in succession to each other.

When a radio wave is incident with an inclination to the flat plane S, the pattern of Fresnel zone becomes an elliptic group. For example, when the radio wave is incident with an elevation angle to the flat plane S as indicated by a line A'–B' in FIG. 2, there is provided an elliptic circle group each having a long axis passing vertically through the point C in the flat plane S wherein a plurality of elliptic annular radio wave transmitting portions and radio wave non-transmitting portions are formed alternately in succession to each other.

The wavelength of the radio wave may be a specified single wavelength such as, for example, $\lambda$, or a wavelength having a certain band width.

As the Fresnel zone portion formed in the converging member in the first embodiment, a Soret type (for example, a type of arranging metallic layers or the like concentrically) wherein a thin metallic layer or a metallic foil such as aluminum, silver or the like is provided on a substrate having transparency such as a glass sheet, a plastic plate or the like, may be exemplified. Although the metallic foil or the like may be formed on either flat surface of the substrate having transparency, it is preferable in an environmental viewpoint to form it on the surface at the side of fitted member.

A feature of the antenna device of the first embodiment is that a space is formed between the fitted member and the converging member. It is preferable that the sum of the distance between the fitted member and the converging member, which provides the space (namely, the thickness of the space, and when the converging member is inclined relatively to the fitted member, the maximum distance between the fitted member and the converging member) and the thickness of the converging member is 200 mm or less, more preferably, 100 mm or less, in particularly preferably, 50 mm or less, in order to reduce the thickness of the antenna device of the present invention.

Figure 4:
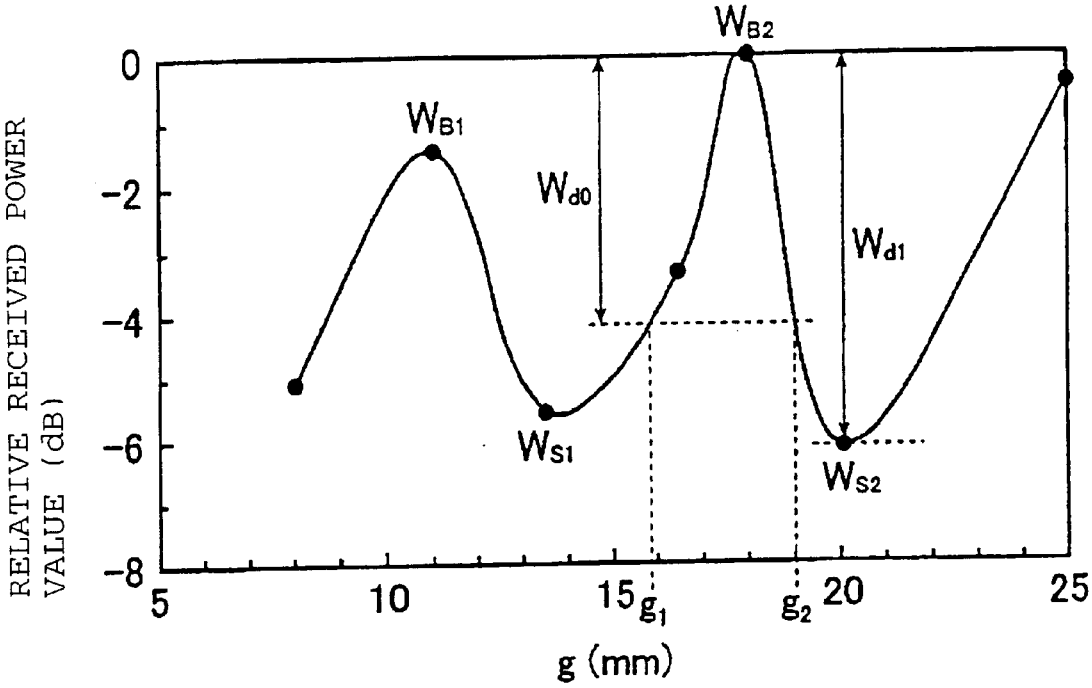
FIG. 4 is a characteristic diagram obtained by measuring a change of the received power value depending on a change of the distance between a fitted member and a converging member.

In the relation of a received power value to the distance between a window glass sheet 4 as a fitted member 5 and a converging member 1 as shown in FIG. 1 and FIG. 4, which will be described hereinafter, the received power value has a plurality of bottom values and a plurality of peak values (one of the bottom values may have the minimum value and one of the peak values may have the maximum value). In FIG. 4, the received power value is expressed in terms of a relative received power value wherein a peak value, (e.g., $W_{B2}$ in FIG. 4) is 0 (zero) dB.

In the present invention, even in a case that the fitted member is in parallel to the converging member, or that the converging member is inclined relatively to the fitted member, the distance between the fitted member and the converging member is determined so that any received power value does not take a value in the vicinity of these bottom values. Namely, in the description with reference to FIG. 4, the distance between the fitted member and the converging member should be determined so that the received power value does not take a value in the vicinity of the bottom values $W_{S1}$ and $W_{S2}$ and other bottom values (not shown in FIG. 4).

Further, even in a case that the fitted member is in parallel to the converging member, or that the converging member is inclined relatively to the fitted member, it is preferable that the distance between the fitted member and the converging member is determined so that the received power value takes a value which approaches a peak value at least ⅔ in the difference in terms of a dB value between the peak value and the bottom value having a smaller value in two bottom values which are at both sides of the peak value (for example, the peak value $W_{S2}$ and the selected bottom value $W_{S1}$).

In FIG. 4, the value of ⅔ of this difference derives a formula of $W_{d1}(-6\text{ dB})\times(2/3)=-4$ dB. It is therefore preferable in FIG. 4 that the distance between the fitted member and the converging member (i.e., a range from $g_1$ to $g_2$) is determined so that the relative received power value approaches a peak value $W_{B2}$ at least −4 dB in an ordinate axis scale (a range indicated by $W_{d1}$). It is more preferable that the distance between the fitted member and the converging member is determined so that the relative received power value approaches the largest peak value at least ½ of the difference, especially, at least ⅓ in the difference. In FIG. 4, $W_{B1}$ is a peak value different from $W_{B2}$.

Since it is supposed that the radio wave converged by the converging member is attenuated by influence due to the multipath reflection caused between the surface of the fitted member and the surface of the converging member, the received power value should be increased by minimizing the influence of the multipath reflection. As described above, the received power value can be increased to receive the radio wave efficiently by providing the space between the fitted member and the converging member wherein the thickness of the space is well adjusted. Further, even in an antenna device other than the above-mentioned lens antenna, a periodic curve having peak values and bottom values appears in the relation between the space and the received power value in the same manner as the case of the lens antenna.

Although a concrete explanation will be made in examples, in the conventional technique, the converging member for converging a radio wave was attached to a window glass sheet or the like by bonding it with an adhesive or by fixing physically by using a jig or the like. However, there was a problem that the converging member had to be contact with the window glass sheet as close as possible because multipath reflection results at each interface on the adhesive layer as a intermediate member, the converging member and the window glass sheet, and the converging efficiency of radio wave decreases due to a standing wave resulted from the multipath reflection.

The inventors of this application have studied this problem and have achieved the present invention by finding the fact that when a space having a specified distance is provided between a converging member and a window glass sheet, on the contrary, the space can appropriately be adjusted, whereby an antenna device having good converging efficiency of radio wave can be obtained.

The above-mentioned space may be constituted by a mechanical element 50 such as a position-adjustable slider disposed previously between the converging member and the window glass sheet, or the space may be provided previous to the antenna device as a fixed space. Further, the space may be provided when the converging member is intalled by using a suitable jig.

The space may be provided between the converging member and the fitted member in substantially parallel or non-parallel. Preferably, the space is provided so that the fitted member is in substantially parallel to the converging member. It is preferable for wireless communication that the converging member having a certain thickness has a Fresnel zone portion which faces the fitted member, and the distance between the fitted member and the Fresnel zone portion (the thickness of the space) in a case that they are substantially parallel, is ⅕ or more as large as a wavelength λ of a radio wave converged or deflected. It is preferable for wireless communication that the distance between the fitted member and the Fresnel zone portion in a case that the Fresnel zone portion of the converging member is provided in the surface opposite to the fitted member and they are substantially parallel, is ⅕ or more as large as a wavelength λ of a radio wave converged or deflected through the thickness of the converging member.

When the space between the Fresnel zone portion of the converging member and the fitted member is not parallel, a preferred range of inclination angle of the converging member to the fitted member is from −10° to +10°, more preferably, from −5° to +5°, in particular preferably, from −2° to +2°. Either the inclination angle or the distance may be provided, or the both may be provided.

When the space is a closed space between the fitted member and the converging member, air should be filled in the space from an economical viewpoint. When inert gas such as nitrogen gas or the like is filled in the space, the deterioration of the fitted member and the converging member can be prevented.

Further, in a method for arranging the converging member to an adjusted position in a space with respect to the fitted member such as a window glass sheet in a building, the converging member may be inclined to the fitted member after the converging member has been arranged at a predetermined position to keep the distance to the fitted member to be parallel, or the both members may be positioned with a predetermined inclination angle so as to form a predetermined distance between the both members.

Specifically, the above-mentioned distance and the inclination angle are adjusted so that when a radio wave is received by a receiver through the fitted member and the converging member, the received radio wave does not take a value in the vicinity of the before-mentioned bottom values. As described later, when the fitted member and the converging member are arranged to be substantially parallel, and the thickness of the space between the fitted member and the converging member is changed, the relative received power value shows values as shown in FIG. 4 as a result of measurement. It was understood from FIG. 4 that the received power value measured by changing the thickness of the space varied substantially periodically.

The received power is subjected to various factors which act on complicatedly. Accordingly, it is difficult to design previously or to predict the structure of the antenna device. Therefore, it is preferable to design preliminarily the antenna device and to adjust the thickness of the space by measuring the received power.

In particular, when the thickness of the fitted member satisfies the above-mentioned formula (1) with respect to the wavelength of a radio wave and the incident angle of the radio wave, the thickness of the space should be adjusted so that the received power value in a case of changing the thickness of the space does not take a value in the vicinity of bottom values. The adjustment of the thickness will be described later.

By providing such space, the antenna device according to the first embodiment can reduce the attenuation of the received power due to the multipath reflection at the interface. Further, in receiving a radio wave by the Fresnel zone portion of the converging member, it is possible to adjust minutely the position of the Fresnel zone portion with respect to the direction of receiving the radio wave. Accordingly, the converging member can correctly be directed to the direction of a coming radio wave whereby the converging efficiency of the radio wave can be increased.

The antenna device according to the first embodiment has a transmitting portion arranged at a position to which the radio wave is converged and/or a receiving portion. The structure of the transmitting portion and/or the receiving portion is not limited. The structure of performing both transmitting and receiving functions, or the structure performing solely transmitting or receiving may be used. Further, a commercially available structure, or the structure described in a related publication may be used. FIG. 1 shows a preferable example of the structure comprising a radiator 7 and a converter 8.

The transmitting portion and/or a receiving portion 2 is preferably supported and fixed on a mounting table which is capable of changing the angle and the height in a predetermined range. In a case that a fitted member 5 is a window glass sheet 4 in the first embodiment of the present invention, the mounting table may be attached to a support arm fixed to a window frame 6. The radiator 7 in FIG. 1 is shown as having a horn structure. However, it may be constituted by a spiral member, a dipole, a strip line, a slot or the like.

Next, description will be made as to a second embodiment.

The antenna device according to the second embodiment comprises a flat fitted member having transparency, an antenna member for transmitting and/or receiving a radio wave and a space between the fitted member and the antenna member wherein in a case that a received power value is changed so as to take alternately a bottom value and a peak value depending on a change of the thickness of the space in the relation between the thickness of the space and the received power value in the antenna member, the thickness of the space is adjusted so that the received power value does not take a value in the vicinity of bottom values, preferably, the received power value takes a value in the vicinity of peak values.

The antenna member in the second embodiment may be any known antenna such as an aperture antenna having a substantially flat aperture, e.g., a reflector antenna, a horn antenna, or the lens antenna in the first embodiment which transmits/receives a radio wave by using the converging member, or the like. Further, as an antenna other than the above-mentioned antennas, there are, for example, a slot array antenna having a flat structure which is constituted by a slot array formed on the conductive wall surface of a waveguide and a strip line, and a planar antenna such as an array antenna having a flat structure in which microstrip antennas as elements are arranged flat. Further, the transmitting portion and/or the receiving portion 2 may be unified with the converging member 1, in the example of FIG. 1, to form an antenna member. Namely, the antenna member may be provided with the converging member.

Namely, the antenna member in the second embodiment may be either the aperture antenna or the planar antenna. Since the received power value varies periodically taking a peak value and a bottom value depending on a change of the thickness of the space between the fitted member and the antenna member (e.g., the distance g in the example of FIG. 1), the thickness of the space is adjusted and determined so that the received power value does not take a value in the vicinity of bottom values, preferably, the received power value takes a value in the vicinity of peak values. By such arrangement, the transmitting/receiving characteristics can be improved.

The variation of the received power value taking alternately a peak value and a bottom value depending on a change of the thickness of the space is derived from multipath reflection and so on caused between the fitted member and the antenna member, and the multipath reflection influences variously depending on the thickness of the fitted member, the wavelength and the incident angle of a radio wave.

A case that a window glass sheet is used as the fitted member and the thickness of the fitted member is the thickness of the window glass sheet will be described as an example. When the relative permittivity of the window glass sheet is $\epsilon_r$, the wavelength of a radio wave is $\lambda$, and the incident angle of the radio wave to the window glass sheet is $\theta$, and when the thickness L of the window glass sheet is expressed by the following formula (4), the difference between a peak value and a bottom value of the received power value which can take depending on a change of the thickness of the space becomes minimal. Namely, the influence of the multipath reflection caused between the fitted member and the antenna member is lessened. In formula (4), the dielectric loss of the window glass sheet is neglected.

$$L = \frac{n'}{2} \cdot \frac{\lambda}{\sqrt{\varepsilon_r - \sin^2\theta}} \tag{4}$$

where n' is an integer of 0 or more, $\lambda$ is a wavelength of the radio wave in vacuum, $\epsilon_r$ is the relative permittivity of the fitted member, and $\theta$ is an incident angle of the radio wave.

The above-mentioned principle will be described with reference to the drawing.

Figure 5:
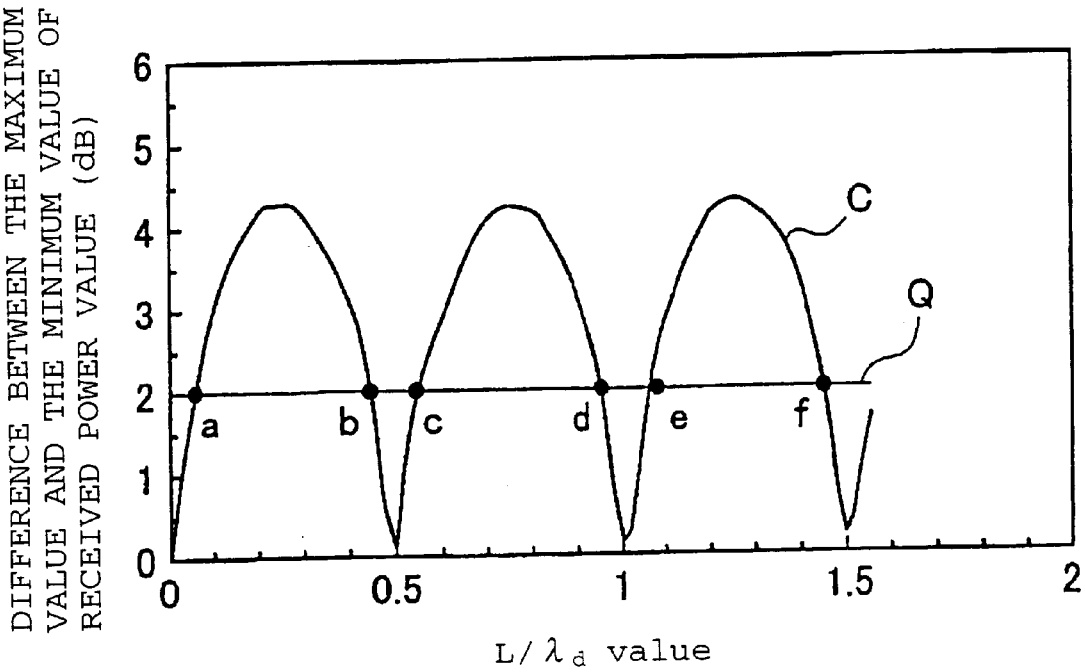
FIG. 5 is a characteristic diagram showing a change of the difference of the maximum value and the minimum value of the received power value depending on the thickness of the fitted member.

FIG. 5 is a characteristic diagram showing how the difference of the maximum value and the minimum value of the received power value changes depending on a change of the thickness L of a window glass sheet in the case that the window glass sheet is a window glass sheet made of soda lime glass (relative permittivity $\epsilon_r$=7.0), the incident angle $\theta$ of a radio wave is 0° and the distance g (see FIG. 1) is changed from 0 mm to 100 mm. Here, the ordinate of the characteristic diagram in FIG. 5 indicates the difference in terms of the dB value between the maximum value and the minimum value of the relative received power value when the distance g is changed from 0 mm to 100 mm, namely, it is expressed in terms of $10\times\log_{10}$ (the maximum value of received power/the minimum value of received power). The abscissa of the characteristic diagram in FIG. 5 indicates a standardized value obtained by dividing the thickness L of the soda lime window glass sheet by the wavelength $\lambda_d$ of a radio wave passing through the soda lime window glass sheet.

In the characteristic diagram shown in FIG. 5, the difference between the maximum value and the minimum value of the received power value exhibits a characteristic curve C by the influence of the multipath reflection caused between the soda lime window glass sheet as the fitted member and the converging member.

According to the characteristic curve C, the received power value takes a substantially constant value irrespective of the distance g when the value $L/\lambda_d$ is, for example, 0, 0.5, 1.5, . . . , i.e., a value of about n'/2 (n' is an integer of 0 or more). Namely, the difference between the maximum value and the minimum value of the received power value, i.e., the change of the received power value to the distance g is small. When the value $L/\lambda_d$ gradually deviates from the vicinity of the value n'/2, the change of the received power value gradually increases according to an increase or a decrease of the $L/\lambda_d$ value, and the change of the received power value becomes the largest to form a peak. When the $L/\lambda_d$ value increases further, the change of the received power value becomes smaller until the $L/\lambda_d$ value reaches (n'+1)/2. Then, the received power value repeats such change according to the $L/\lambda_d$ value in accordance with the characteristic curve C.

As described above, the difference between the maximum value and the minimum value of the received power value is subjected to influence by the multipath reflection caused between the soda lime window glass sheet as the fitted member and the converging member, and it is understood that the influence by the multipath reflection and so on can be reduced when the thickness of the soda lime window glass sheet, the wavelength $\lambda_d$ of the radio wave and the incident angle θ of the radio wave satisfy formula (4).

Accordingly, when the thickness L of the window glass sheet takes a value in the vicinity of the value expressed by formula (4), there is a low possibility of occurrence of the problem caused by the multipath reflection, and excellent radio wave transmitting/receiving operations can be conducted. Namely, the necessity of adjusting the distance g is little since the difference between the maximum value and the minimum value of the received power value in a change of the distance g is small and the change of the received power value to the distance g is small.

On the other hand, when the thickness L of the window glass sheet takes a value which is apart from the vicinity of the value of the formula (4), the change of the received power value to the distance g becomes large. This means that an inappropriate determination of the distance g invites a reduction of the received power value. When the reduction of the received power value is within 2 dB, a good radio wave transmitting/receiving effect can be realized and there is almost no trouble on wireless communication. When the reduction of the received power value exceeds 2 dB, in other words, the distance between the maximum value and the minimum value of the received power value exceeds 2 dB, the distance g should be determined appropriately to prevent the reduction of the received power value. Thus, an antenna device having excellent transmitting/receiving characteristics can be obtained.

The condition of making the adjustment of the distance g unnecessary in the relation of the thickness L of the soda lime window glass sheet and the wavelength $\lambda_d$ can be defined by the intersecting points of the characteristic curve C to a linear line Q indicating that the difference between the maximum value and the minimum value of the received power value is 2 dB, in FIG. 5.

Namely, since the difference between the maximum value and the minimum value of the received power value is smaller than 2 dB in ranges excluding a range of from the point a to the point b, a range of from the point c to the point d and a range of from the point e to the point f in FIG. 5, the necessity of adjusting the distance g is little in these ranges. Here, there are (¼−⅕) at the point a, (¼+⅕) at the point b, (¾−⅕) at the point c, (¾+⅕) at the point d, (⅝−⅕) at the point e and (⅝+⅕) at the point f. In FIG. 5 specifically, $L/\lambda_d$=0.05 at the point a, $L/\lambda_d$=0.45 at the point b, $L/\lambda_d$=0.55 at the point c, $L/\lambda_d$=0.95 at the point d, $L/\lambda_d$=1.05 at the point e and $L/\lambda_d$=1.45 at the point f. The ranges between the point a and the point b, between the point c and the point d and between the point e and the point f are determined substantially from formula (1) or formula (2).

On the other hand, in the ranges of from the point a to the point b, from the point c to the point d and from the point e to the point f, namely, the ranges obtained by dividing the thickness L expressed by formula (1) by the wavelength $\lambda_d$, the difference between the maximum value and the minimum value of the received power value is more than 2 dB, whereby the multipath reflection and so on will affect largely. Accordingly, the distance g as the thickness of the space should be adjusted, namely, the thickness of the space between the soda lime window glass sheet and the converging member should be determined appropriately so that the received power value does not take a value in the vicinity of bottom values, more preferably, the received power value takes a value in the vicinity of peak values.

Namely, in a case that the multipath reflection and so on affect largely in receiving a radio wave in the ranges of from the point a to the point b, from the point c to the point d and from the point e to the point f, the distance g should be adjusted so as to increase the received power value as possible. In particular, it is preferable to adjust the distance g so that the received power value takes a value in the vicinity of the peak values in the relation between the distance g and the received power value.

The inventors have achieved the present invention by finding the fact that when the thickness L of a window glass sheet as the fitted member satisfies the value of the above-mentioned formula (1) with respect to the wavelength λ of a radio wave and the incident angle θ of the radio wave, it is in particular important to obtain an antenna device having good transmitting/receiving characteristics by adjusting and determining the distance g of the space between the fitted member and the antenna member.

Preferred embodiments of the present invention will be described with reference to the drawings. FIG. 1 is a diagram showing a side face of the antenna device according to first and second embodiments of the present invention. In FIG. 1, a window glass sheet 4 is supported by a window frame 6 to define an outdoor side to which a radio wave 3 is incident and a room side as an opposite side thereof. A converging member 1 having a Fresnel zone portion formed at a window glass sheet side is disposed facing the window glass sheet 4 in substantially parallel so as to have a space with a distance g. A transmitting portion and/or a receiving portion 2 is disposed at the focal position of the converging member 1. A radio wave 3 passes through the window glass sheet 4 and the converging member 1 to be converged to the transmitting portion and/or the receiving portion 2. The converging member 1 and the transmitting portion and/or the receiving portion 2 constitute the antenna member in the second embodiment of the present invention.

Then, in the antenna device shown in FIG. 1, the change of the received power value was measured by changing the distance g between the window glass sheet 4 as a fitted member 5 and the converging member 1, and using a commercially available circular waveguide probe as the transmitting portion and/or the receiving portion 2. A result of the measurement is shown in FIG. 4. The radio wave 3 was transmitted at a frequency of 22.605 GHz from the outdoor side, and the window glass sheet 4 was a soda lime glass sheet having a thickness of 5.8 mm. The Fresnel zone portion was formed according to the dimension and the method used in each of the examples described later, and the fitted member 5 was arranged in substantially parallel to the converging member 1 as shown in FIG. 1 wherein the circular waveguide probe was disposed at a position of the distance between the transmitting portion and/or the receiving portion 2 and the converging member f=200 mm.

In FIG. 4, the ordinate indicates the measured received power in terms of a relative value wherein the maximum received power value is 0 dB and the abscissa indicates the distance g. FIG. 4 shows that a change of the distance g causes a change of the received power by about 6 dB. By adjusting appropriately the distance (the thickness of a space) g between the fitted member and the converging member to form a space wherein the received power value can take the substantially maximum value, the reduction of the converging efficiency due to the mutual influence of the window glass sheet 4 and the converging member 1 can be lessened.

In the second embodiment, the distance g is adjusted so that the received power value does not take a value in the vicinity of bottom values. In this case, it is preferable that the distance g is adjusted and determined so that the received power value takes a value in the vicinity of peak values.

In the second embodiment, in either case that the fitted member and the converging member are in parallel to each other or that the converging member is inclined relatively to the fitted member, the distance g is adjusted and determined so that the received power value takes a value which approaches a peak value at least ⅔, preferably at least ½, more preferably ⅓ in the difference in terms of a dB value between the peak value and the bottom value having a smaller value in two bottom values which are at both sides of the peak value.

In particular, in the second embodiment, a case that the received power value is changed so as to take alternately a bottom value and a peak value in a change, e.g., in a range of from 0 to 100 mm, of the distance g, the distance g should be adjusted and determined so that the received power value takes a peak value, more preferably the largest peak value (i.e. the maximum value).

Further, the reduction of the converging efficiency due to the influence of the window glass sheet and the converging member 1 can be lessened even by providing an inclination angle between the window glass sheet 4 and the converging member 1 without arranging the window glass sheet 4 in substantially parallel to the converging member 4. Thus, the change of the converging efficiency by the adjustment of the gap g and/or the provision of the inclination angle is likely caused by the influence of the multipath reflection of a radio wave between the window glass sheet 4 and the converging member 1.

According to the first embodiment of the present invention, an antenna device which can easily lessen the influence of multipath reflection of a radio wave by providing a space between the converging member and the fitted member, is provided wherein the distance g of the space and/or the inclination angle of the window glass sheet to the converging member can be adjusted.

According to the second embodiment, the distance g of the space is adjusted in a case that the thickness L of the glass sheet satisfies formula (1) with respect to the wavelength $\lambda$ and the incident angle $\theta$ of a radio wave.

Now, the present invention will be described with reference to Examples. However, it should be understood that the present invention is by no means restricted by such specific Examples, and various improvements or modifications are included in the present invention as far as the spirit of the present invention is maintained.

EXAMPLE 1

An antenna device as shown in FIG. 1 was prepared by using a commercially available circular waveguide probe as a transmitting portion and/or a receiving portion 2. A commercially available soda lime window glass sheet 4 (relative permittivity $\epsilon_r$=7.0) having a thickness of 5.8 mm was used as a fitted member 5, and the distance f=200 mm.

A converging member 1 as a Fresnel zone plate was prepared by bonding an aluminum foil on a surface of a commercially available soda lime glass sheet having a thickness of 2.7 mm to provide such construction as shown in FIG. 3 and to have the following dimensions. Then, the converging member was disposed so that a Fresnel zone portion faces the fitted member 5. In FIG. 3, a hatched portion indicates the portion bonded with the aluminum foil.

$2r_1$=104 mm, $2r_2$=148 mm, $2r_3$=182 mm, $2r_4$=212 mm, $2r_5$=240 mm, $2r_6$=264 mm, $2r_7$=288 mm.

Then, the converging member 1 was disposed facing the window glass sheet 4 by interposing spacers so that the distance g between the window glass sheet 4 and the converging member 1 was g=18 mm as shown in FIG. 1. The frequency of a coming radio wave was determined to be 22.605 GHz (wavelength $\lambda$=13.3 mm) in order to receive the radio wave. Then, the reduction of the converging efficiency by the influence of the window glass sheet could be lessened, and the radio wave could be received under good condition.

EXAMPLE 2

An antenna device as shown in FIG. 1 was prepared by using a commercially available circular waveguide probe as a transmitting portion and/or a receiving portion 2. A commercially available soda lime window glass sheet 4 (relative permittivity $\epsilon_r$=7.0) having a thickness of 3.5 mm was used as a fitted member 5, and the distance f=100 mm.

A converging member 1 as a Fresnel zone plate was prepared by bonding an aluminum foil on a surface of a commercially available soda lime glass sheet 4 having a thickness of 2.4 mm to provide such construction as shown in FIG. 3 and to have the following dimensions. Then, the converging member was disposed so that a Fresnel zone portion faces the transmitting portion and/or the receiving portion 2. In FIG. 3, a hatched portion indicates the portion bonded with the aluminum foil.

$2r_1$=69 mm, $2r_2$=99 mm, $2r_3$=123 mm, $2r_4$=143 mm, $2r_5$=162 mm, $2r_6$=180 mm, $2r_7$=197 mm.

Figure 6:
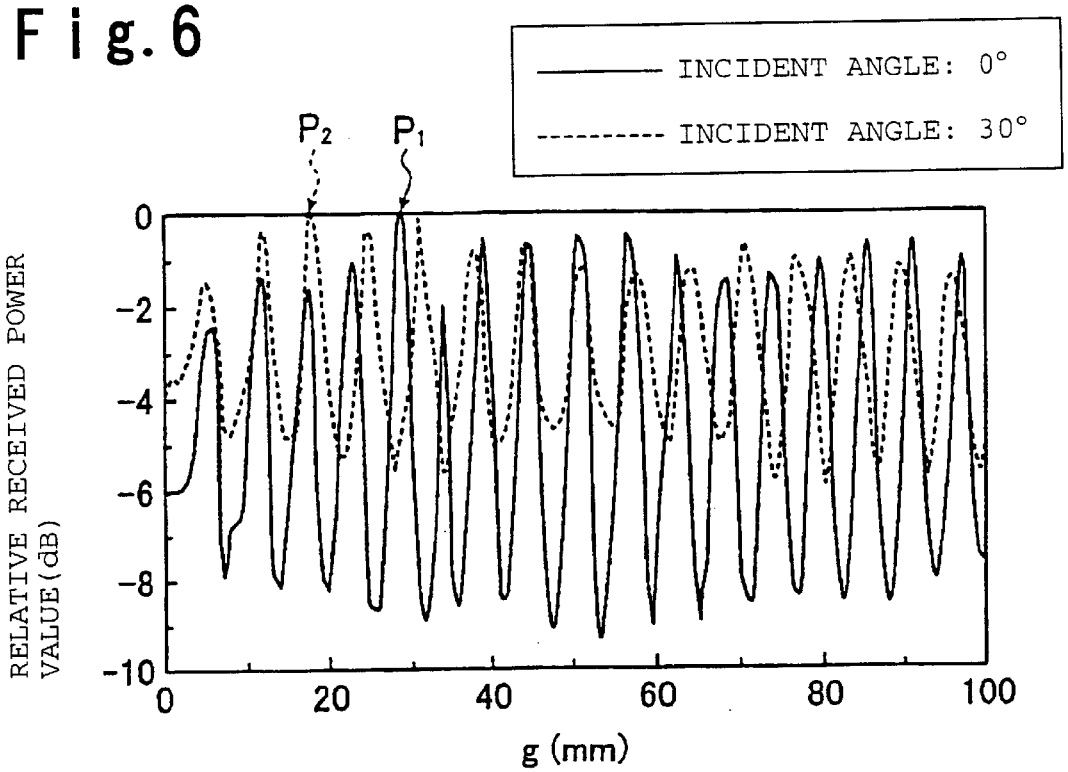
FIG. 6 is a characteristic diagram of another embodiment obtained by measuring a change of the relative received power value when the distance between the fitted member and the converging member is changed.

FIG. 6 shows the relation of the received power value to the distance g between the soda lime window glass sheet 4 as the fitted member 5 and the converging member 1 in a case that the frequency of a radio wave was determined to be 26.000 GHz (wavelength $\lambda$=11.5 mm) and the incident angle in azimuth direction of the radio wave to the fitted member 5 is 0° and 30°. FIG. 6 is a characteristic diagram showing the relation of the distance g to the relative received power value wherein the ordinate indicates the relative received power value and the abscissa indicates the distance g.

In FIG. 6, the solid line shows a result when the incident angle is 0° and the dotted line shows a result when the incident angle is 30°. In this case, the value of $L/\lambda_d$ is 0.8 which is within the value range obtained by dividing the range expressed by the above-mentioned formula (1) by the wavelength $\lambda_d$, i.e., the range of $0.55<L/\lambda_d<0.95$.

Then, in a case of the incident angle being 0°, the distance g between the converging member 1 and the window glass sheet 4 was adjusted to 29 mm (the point $P_1$ in FIG. 6) by using spacers so that the relative received power value took the maximum value as shown in FIG. 1. Further, in a case of the incident angle being 30°, the distance g was adjusted to 18 mm (the point $P_2$ in FIG. 6) by using spacers so that the relative received power value took the maximum value. In receiving a coming radio wave, the reduction of the converging efficiency by the influence of the window glass sheet 4 could be lessened, and the radio wave could be received under good condition.

EXAMPLE 3

An antenna device as shown in FIG. 1 was prepared by using a commercially available circular waveguide probe as a transmitting portion and/or a receiving portion 2. A commercially available soda lime window glass sheet 4 (relative permittivity $\epsilon_r$=7.0) having a thickness of 3.5 mm was used as a fitted member 5, and the distance f=100 mm.

Figure 7:
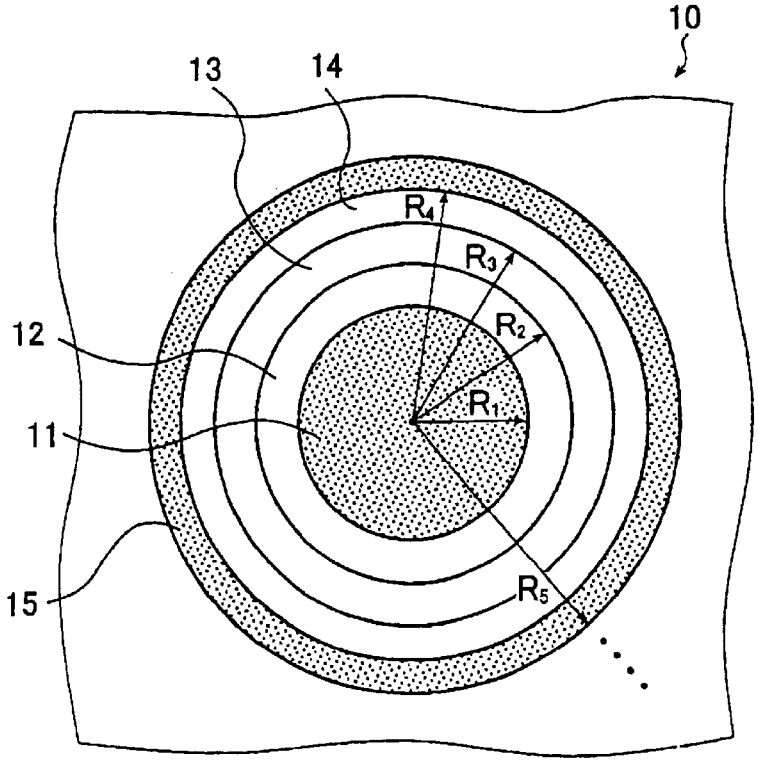
FIG. 7 is a front view showing a phase correction type Fresnel lens used in Example 3.
Figure 8:
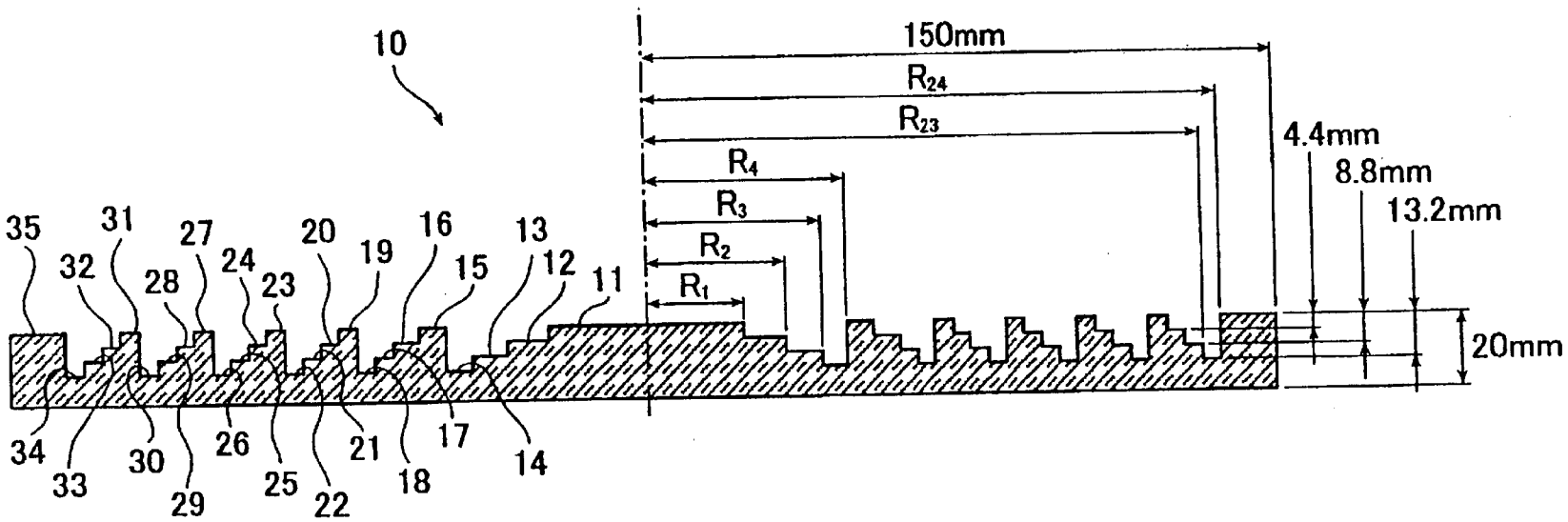
FIG. 8 is a cross-sectional view showing the phase correction type Fresnel lens used in Example 3.

FIG. 7 is a front view showing a phase correction type Fresnel lens used as a converging member 1, and FIG. 8 is a cross-sectional view showing the phase correction type Fresnel lens. In this embodiment, a commercially available acrylic plate having a thickness of 20 mm was used to prepare the phase correction type Fresnel lens 10 having a diameter of 300 mm as such having a three-dimensional shape as shown in FIG. 8.

The phase correction type Fresnel lens 10 has 6 subzone groups formed by recessing stepwisely the acrylic plate in its thickness direction to adjust the thickness, i.e., the second to the fourth subzones 12 to 14, the sixth to the eighth subzones 16 to 18, the tenth to the twelfth subzones 20 to 22, the fourteenth to the sixteenth subzones 24 to 26, the eighteenth to the twentieth subzones 28 to 30 and the twenty second to the twenty fourth subzones 32 to 34. These groups are respectively provided between the first subzone 11 and the fifth subzone 15, between the fifth subzone 15 and the ninth subzone 19, between the ninth subzone 19 and the thirteenth subzone 23, between the thirteenth subzone 23 and the seventeenth subzone 27, between the seventeenth subzone 27 and the twenty first subzone 31 and between the twenty first subzone 31 and the twenty fifth subzone 35 in the acrylic plate having the original thickness before the formation of the above-mentioned recessed subzones.

These subzones constitute diffraction elements to a radio wave, which utilize thicknesses formed in the acrylic plate as a dielectric substance and constitute the converging member for correcting the phase of the radio wave. An open side of the stepwisely formed recessed portions was disposed facing the fitted member 5. The dimensions of each element of the Fresnel lens 10 in this Example can be obtained according to the following formula (5) where λ is a wavelength of a radio wave propagating in vacuum and F is the focal distance.

$$R_k = \sqrt{\frac{2k\lambda F}{4} + \left(\frac{k\lambda}{4}\right)^2} \tag{5}$$

where k is an integer of 1 or more.

The dimensions of each element of the Fresnel lens 10 obtained by the above-mentioned formula (5) are as follows. The figures do not show $R_5$ to $R_{22}$. However, it should be understood that $R_1$, $R_2$, $R_3$ . . . $R_{24}$ indicate respectively the distance (radius) from the center 100 of the Fresnel lens 10 to the step with respect to each step arranged successively from the center 100 toward an outer periphery of the lens 10.

$2R_1$=48.0 mm, $2R_2$=68.4 mm, $2R_3$=84.4 mm, $2R_4$=98.2 mm, $2R_5$=110.4 mm, $2R_6$=121.8 mm, $2R_7$=132.4 mm, $2R_8$=142.4 mm, $2R_9$=152.0 mm, $2R_{10}$=161.4 mm, $2R_{11}$=170.2 mm $2R_{12}$=179.0 mm, $2R_{13}$=187.4 mm, $2R_{14}$=195.6 mm, $2R_{15}$=203.6 mm, $2R_{16}$=211.6 mm, $2R_{17}$=219.4 mm, $2R_{18}$=227.0 mm, $2R_{19}$=234.6 mm, $2R_{20}$=242.0 mm, $22_1$=249.4 mm $2R_{22}$=256.6 mm, $2R_{23}$=263.8 mm, $2R_{24}$=270.8 mm.

Figure 9:
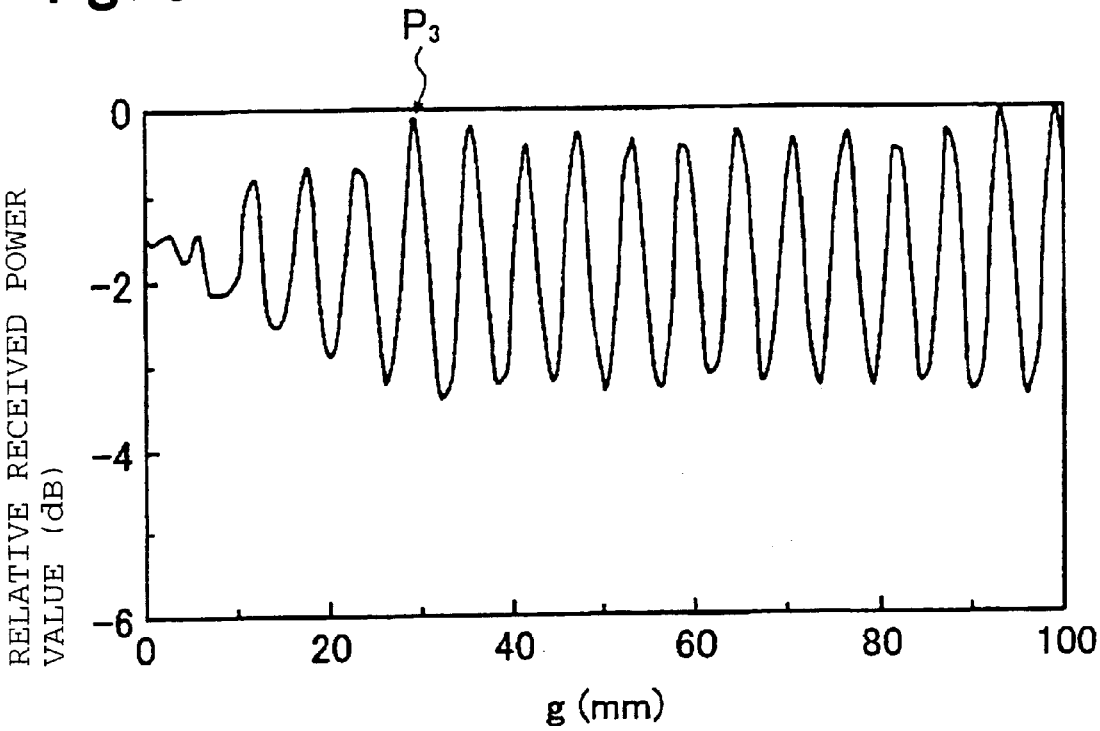
FIG. 9 is a characteristic diagram obtained by measuring a change of the relative received signal value when the distance between the fitted member and the converging member is changed in Example 3.

FIG. 9 shows the relation of the received power value to the distance between the soda lime window glass 4 as the fitted member 5 and the converging member 1 in a case that the frequency of a radio wave is 26.500 GHz (wavelength λ=11.3 mm) and the incident angle in azimuth direction of the radio wave to the fitted member 5 is 0°. FIG. 9 is a characteristic diagram showing the relation of the distance g to the relative received power value wherein the ordinate indicates the relative received power value and the abscissa indicates the distance g. In this case, the value of $L/\lambda_d$ is 0.82 which is within the value range obtained by dividing the range expressed by the above-mentioned formula (1) by the wavelength $\lambda_d$, i.e., the range of $0.55<L/\lambda_d<0.95$.

Then, in a case of the incident angle being 0°, the distance g between the phase correction type Fresnel lens 10 as the converging member 1 and the window glass sheet 4 was adjusted to 29 mm (the point $P_3$ in FIG. 9) by using spacers so that the relative received power value took the maximum value as shown in FIG. 1. In receiving a coming radio wave, the reduction of the converging efficiency by the influence of the window glass sheet 4 could be lessened, and the radio wave could be received under good condition.

EXAMPLE 4

Figure 10:
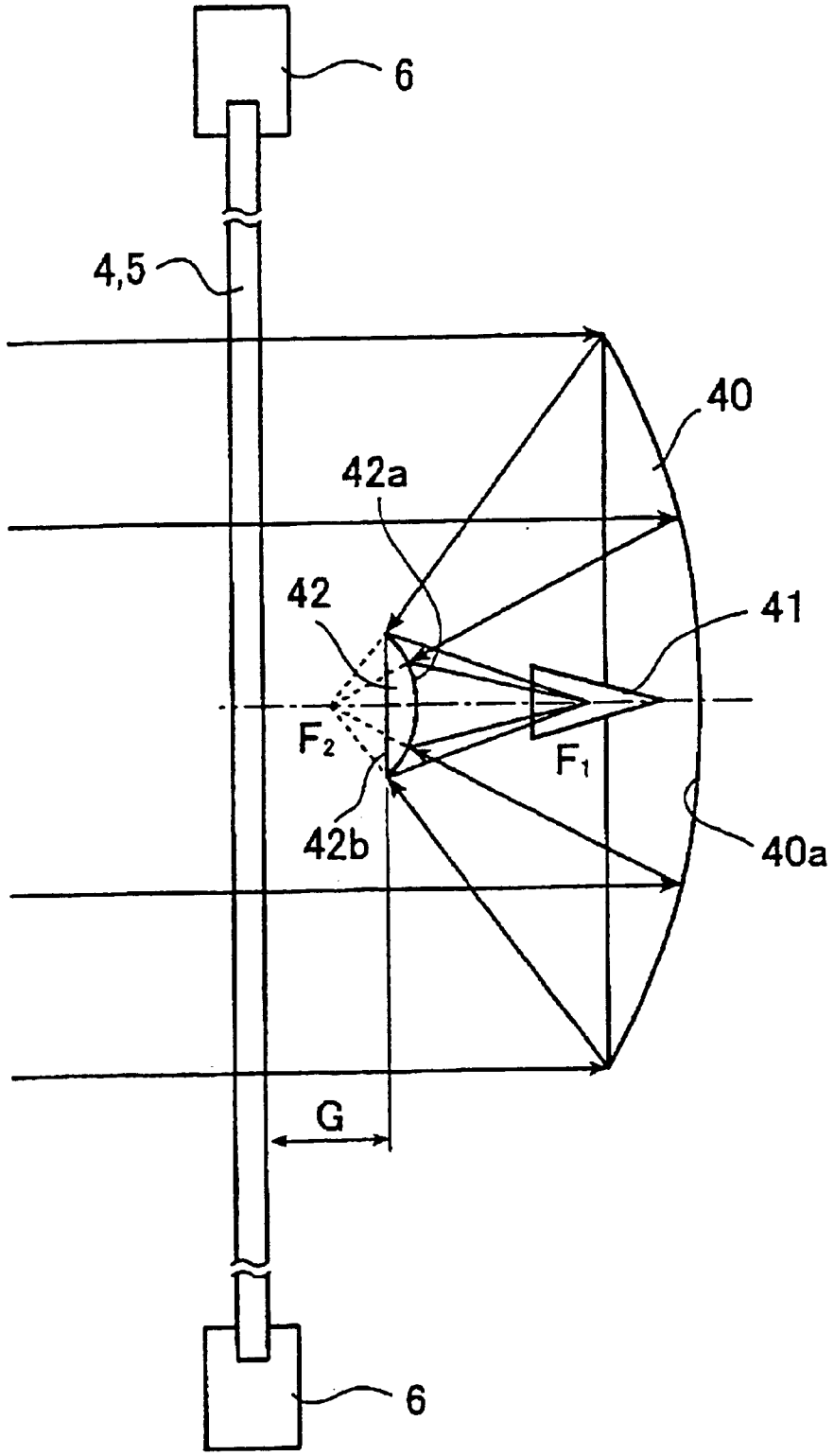
FIG. 10 is a diagrammatic view showing a Cassegrain antenna used in the antenna device in Example 4.

An antenna device was prepared by using a commercially available Cassegrain antenna, which is a kind of a reflector antenna, as an antenna member. FIG. 10 is a diagram showing the Cassegrain antenna used for the antenna device of this Example. The Cassegrain antenna comprises a main reflector 40 having a paraboloid 40*a*, a primary radiator 41 corresponding to a transmitting portion and/or a receiving portion 2 and a subreflector 42 having a hyperboloid 42*a* wherein the paraboloid 40*a* of the main reflector 40 is disposed to oppose to the hyperboloid 42*a* of the subreflector 42. In the Cassegrain antenna, the distance G between the fitted member 5 and a rear surface 42*b* of the subreflector 42 corresponds to the distance g between the fitted member 5 and the converging member 1 shown in FIG. 1. In this Example, a commercially available soda lime window glass sheet 4 (relative permittivity $\epsilon_r$=7.0) having a thickness of 3.5 mm was used as the fitted member 5.

Figure 11:
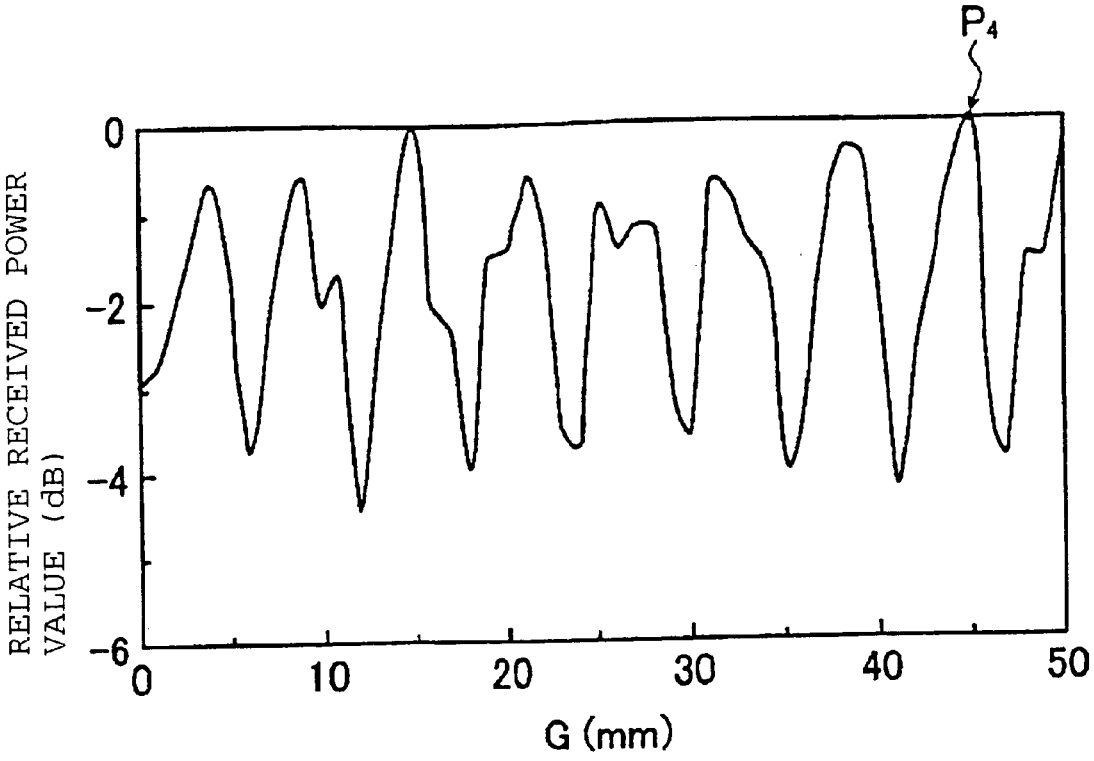
FIG. 11 is a characteristic diagram obtained by measuring a change of the relative received power value when the distance G is changed in Example 4.

FIG. 11 shows the relation of the received power value to the distance G between the soda lime window glass 4 as the fitted member 5 and the Cassegrain antenna in a case that the frequency of a radio wave is 26.000 GHz (wavelength λ=11.5 mm) and the incident angle in azimuth direction of the radio wave to the fitted member 5 is 0°. FIG. 11 is a characteristic diagram showing the relation between the relative received power value and the distance G wherein the ordinate indicates the relative received power value and the abscissa indicates the distance G. In this case, the value of $L/\lambda_d$ is 0.8 which is within the value range obtained by dividing the range expressed by the above-mentioned formula (1) by the wavelength $\lambda_d$, i.e., the range of $0.55<L/\lambda_d<0.95$.

Then, in the case of the incident angle being 0°, the distance G between the subreflector 42 and the window glass sheet 4 was adjusted to 45 mm (the point $P_4$ in FIG. 11) by using spacers so that the relative received power value took the maximum value as shown in FIG. 10, and the Cassegrain antenna was disposed facing the window glass sheet 4. In receiving a coming radio wave, the reduction of the converging efficiency by the influence of the window glass sheet 4 could be lessened, and the radio wave could be received under good condition.

As described above, in accordance with the antenna device of the present invention, a space having a high converging efficiency to a radio wave can be provided at the time of arranging a converging member for converging a radio wave to a fitted member so as to face the fitted member having a visual transparency, whereby a high radio wave receiving performance can be obtained even by a simple structure. Further, the converging member for converging the radio wave may be of any construction. Accordingly, the antenna device which can easily be set in a building and has durability without suffering deterioration due to wind and snow, can be realized. Further, it can preferably be used for microwave wireless communication, e.g., FWA, fixed wireless access and so on as an antenna device having a high converging efficiency, without damaging an outer appearance of an architectural structure.

In particular, even in a case that the fitted member such as a glass sheet or the like having various thicknesses is used, or various wavelengths of the radio wave or various incident directions of the radio wave are used in the antenna device of the present invention, the transmission and the reception of a radio wave can be obtained efficiently while the influence of the multipath reflection is minimized, by adjusting the distance between the antenna member and the fitted member.

The entire disclosure of Japanese Patent Application No. 2000-372819 filed on Dec. 7, 2000 including specification, claims, drawings and summary are incorporated herein by reference in its entirety.

What is claimed is:

1. An antenna device comprising:

a fitted member having transparency;

a converging member for converging a radio wave;

a space between the fitted member and the converging member; and at least one of a receiving portion for receiving the radio wave converged by the converging member and a transmitting portion for radiating a radio wave to the converging member;

wherein the fitted member is a window glass sheet fitted to a building; and wherein the converging member has a face, and the space is a space constituted by inclining relatively the converging member with respect to the window glass sheet to an angle other than parallel.

2. The antenna device according to claim 1, wherein in a case that a received power value is changed so as to take alternately a bottom value and a peak value depending on a change of the thickness of the space in the relation between the thickness of the space and the received power value, the thickness of the space is adjusted so that the received power value does not take a value in the vicinity of bottom values.

3. The antenna device according to claim 2, wherein in a case that the thickness of the fitted member satisfies the following formula (1) with respect to the wavelength of the radio wave and the incident angle of the radio wave, the space has an adjusted thickness:

$$\left(\frac{2n+1}{4}-\frac{1}{5}\right)\cdot\lambda_d \le L \le \left(\frac{2n+1}{4}+\frac{1}{5}\right)\cdot\lambda_d \quad (1)$$

where n is an integer of 0 or more;

$\lambda_d$ is a wavelength of the radio wave passing through the fitted member;

$$\lambda_d = \frac{\lambda}{\sqrt{\varepsilon_r - \sin^2\theta}}$$

($\lambda$ is a wavelength of the radio wave in vacuum, $\epsilon_r$ is the relative permittivity of the fitted member, and $\theta$ is an incident angle of the radio wave), and L is a thickness of the fitted member.

4. The antenna device according to claim 1, wherein in a case that a received power value is changed so as to take alternately a bottom value and a peak value depending on a change of the thickness of the space in the relation between the thickness of the space and the received power value, the thickness of the space is adjusted so that the received power value takes a value which approaches a peak value at least ⅔ in the difference in terms of a dB value between the peak value and the bottom value having a smaller value in two bottom values which are at both sides of the peak value.

5. The antenna device according to claim 1, wherein the sum of the maximum distance between the window glass sheet and the converging member, and the thickness of the converging member is 200 mm or less.

6. The antenna device according to claim 1, further comprising a mechanical adjustment element configured to incline the converging member.

7. An antenna device comprising:

a fitted member having transparency;

a converging member for converging a radio wave;

a space between the fitted member and the converging member; and at least one of a receiving portion for receiving the radio wave converged by the converging member and a transmitting portion for radiating a radio wave to the converging member;

wherein in a case that a received power value is changed so as to take alternately a bottom value and a peak value depending on a change of the thickness of the space in the relation between the thickness of the space and the received powder value, the thickness of the space is adjusted so that the received powder value does not take a value in the vicinity of bottom values.

8. The antenna device according to claim 7, wherein in a case that the thickness of the fitted member satisfies the following formula (1) with respect to the wavelength of the radio wave and the incident angle of the radio wave, the space has an adjusted thickness:

$$\left(\frac{2n+1}{4}-\frac{1}{5}\right)\cdot\lambda_d \le L \le \left(\frac{2n+1}{4}+\frac{1}{5}\right)\cdot\lambda_d \quad (1)$$

where n is an integer of 0 or more;

$\lambda_d$ is a wavelength of the radio wave passing through the fitted member;

$$\lambda_d = \frac{\lambda}{\sqrt{\varepsilon_r - \sin^2\theta}}$$

($\lambda$ is a wavelength of the radio wave in vacuum, $\epsilon_r$ is the relative permittivity of the fitted member, and $\theta$ is an incident angle of the radio wave), and L is a thickness of the fitted member.

9. The antenna device according to claim 7, wherein the sum of the distance between the fitted member and the converging member, and the thickness of the converging member is 200 mm or less.

10. The antenna device according to claim 7, further comprising a position-adjustable slider configured to adjust the position of said space.

11. The antenna device according to claim 7, wherein the space is a closed space between the fitted member and the converging member, said closed space being filled with an inert gas.

12. An antenna device comprising:

a fitted member having transparency;

a converging member for converging a radio wave;

a space between the fitted member and the converging member; and at least one of a receiving portion for receiving the radio wave converged by the converging member and a transmitting portion for radiating a radio wave to the converging member;

wherein in a case that a received powder value is changed so as to take alternately a bottom value and a peak value depending on a change of the thickness of the space in the relation between the thickness of the space and the received power value, the thickness of the space is adjusted so that the received power value takes a value which approaches a peak value at least ⅔ of a difference in terms of a dB value between the peak value and the bottom value having a smaller value in two bottom values which are at both sides of the peak value.

13. The antenna device according to claim 12, further comprising a position-adjustable slider configured to adjust the position of said space.

14. The antenna device according to claim 12, wherein the sum of the distance between the fitted member and the converging member, and the thickness of the converging member is 200 mm or less.

15. An antenna device which comprises a flat fitted member having transparency, an antenna member for performing at least one of transmitting a radio wave and receiving a radio wave and a space between the fitted member and the antenna member wherein in a case that a received power value is changed so as to take alternately a bottom value and a peak value depending on a change of the thickness of the space in the relation between the thickness of the space and the received power value in the antenna member, the thickness of the space is adjusted and determined so that the received power value does not take a value in the vicinity of bottom values.

16. The antenna device according to claim 15, wherein the thickness of the space is determined so that the received power value takes a value which approaches a peak value at least ⅔ in the difference in terms of a dB value between the peak value and the bottom value having a smaller value between two bottom values which are at both sides of the peak value.

17. The antenna device according to claim 15, wherein in a case that the thickness of the fitted member satisfies the following formula (2) with respect to the wavelength of the radio wave and the incident angle of the radio wave, the space has an adjusted thickness under determination:

$$\left(\frac{2n+1}{4} - \frac{1}{5}\right)\cdot\lambda_d \le L \le \left(\frac{2n+1}{4} + \frac{1}{5}\right)\cdot\lambda_d \tag{2}$$

where n is an integer of 0 or more;

$\lambda_d$ is a wavelength of the radio wave passing through the fitted member;

$$\lambda_d = \frac{\lambda}{\sqrt{\varepsilon_r - \sin^2\theta}}$$

($\lambda$ is a wavelength of the radio wave in vacuum, $\epsilon_r$ is the relative permittivity of the fitted member, and $\theta$ is an incident angle of the radio wave), and L is a thickness of the fitted member.

18. The antenna device according to claim 15, further comprising a position-adjustable slider configured to adjust the position of said space.

* * * * *